US006658810B2

(12) United States Patent
DeLoach, Sr.

(10) Patent No.: US 6,658,810 B2
(45) Date of Patent: Dec. 9, 2003

(54) TILT-UP CONCRETE WALL PANEL FORM AND METHOD OF FABRICATING SAME

(76) Inventor: W. Michael DeLoach, Sr., 475 Tucker Rd., Winder, GA (US) 30680

( * ) Notice: Subject to any disclaimer, the term of this patent is extended or adjusted under 35 U.S.C. 154(b) by 0 days.

(21) Appl. No.: 10/107,561

(22) Filed: Mar. 27, 2002

(65) Prior Publication Data

US 2003/0183742 A1 Oct. 2, 2003

(51) Int. Cl.[7] ..... E04B 1/38

(52) U.S. Cl. ..... 52/701; 52/379; 52/414; 52/742.14; 52/745.09; 52/745.11; 249/18; 249/91; 249/190; 249/192

(58) Field of Search ..... 52/677, 699, 698, 52/700, 740, 513, 378, 379, 561, 562, 565, 583, 745.09, 684, 688, 414, 745.11, 742.14; 249/38, 43, 47, 93, 91, 94, 96, 97, 190, 192, 4, 6, 18, 208, 219.1

(56) References Cited

U.S. PATENT DOCUMENTS 3,394,523 A * 7/1968 Sackett, Sr.
3,609,935 A * 10/1971 Thomas
3,806,080 A * 4/1974 Franklin et al. ..... 249/213
4,059,939 A * 11/1977 Elliott ..... 52/745
4,104,356 A * 8/1978 Deutsch et al. ..... 264/297
4,159,097 A * 6/1979 Strickland ..... 249/40
4,291,858 A * 9/1981 NeSmith ..... 249/216
4,506,428 A * 3/1985 Gerhard ..... 29/446
5,205,942 A * 4/1993 Fitzgerald ..... 249/3
5,216,866 A * 6/1993 Ekedal ..... 52/677
5,491,948 A * 2/1996 Harris ..... 52/596
5,635,097 A * 6/1997 Aiello ..... 249/38
6,182,416 B1 * 2/2001 Backin ..... 52/745.09
6,260,329 B1 * 7/2001 Mills ..... 52/794.1
6,502,362 B1 * 1/2003 Zambelli et al. ..... 52/698

* cited by examiner

*Primary Examiner*—Carl D. Friedman
*Assistant Examiner*—Yvonne M. Horton
(74) *Attorney, Agent, or Firm*—Womble Carlyle Sandridge & Rice, PLLC

(57) ABSTRACT

An improved, lightweight, portable, and self-contained concrete form for fabricating tilt-up concrete walls is provided. The form includes a frame made from metal frame members joined at their ends with the frame members forming the sides of the frame. The frame members may be channel shaped with their channels facing inwardly. A reinforcing mat comprising an array of crisscrossed rebars is disposed within the frame and is held in place with a plurality of brackets on the ends of at least some of the rebars and welded to respective frame members. The rebar mat is sized to be positioned in the mid portion of the frame and the brackets on the ends of the rebars are slid outwardly into and attached to the frame members by spot welding. The brackets are then spot welded to the ends of their rebars to form a rigid, lightweight concrete frame. The frame may be shipped to a job site, laid on a casting surface, and filled with concrete, When the concrete cures, the resulting concrete wall, form and all, is tilted-up into place with a crane and attached to form a section of a concrete wall.

10 Claims, 3 Drawing Sheets

TILT-UP CONCRETE WALL PANEL FORM AND METHOD OF FABRICATING SAME

TECHNICAL FIELD

This invention relates generally to building construction and more particularly to the fabrication of concrete wall panels that are tilted up into place and attached to form the walls of a building.

BACKGROUND

Tilt-up concrete wall panel construction has been used for years to construct commercial buildings such as warehouses, factories, and the like. In general, such construction entails building a rectangular concrete form, usually on site, placing steel reinforcing bars (rebar) or other reinforcement in the form, filling the form with concrete, and, after the concrete cures, tilting the resulting concrete panel into place to form a wall section. Numerous wall sections generally are fabricated and attached together and to framing members of the building to form complete walls. Utility conduits may be embedded within the wall sections as needed to provide for electricity and plumbing. U.S. Pat. No. U.S. Pat. No. 3,394,523 of Sackett, U.S. Pat. No. 4,104,356 of Deutsch et al., U.S. Pat. No. 3,604,174 of Nelson, and U.S. Pat. No. 4,856,244 of Clapp disclose various examples of tilt-up concrete wall panel construction techniques.

While traditional concrete wall panel construction techniques have been somewhat successful in constructing commercial buildings, they nevertheless have been fraught with a variety of inherent problems and shortcomings. Among these are the fact that, in most cases, the forms into which the concrete is poured usually are fabricated from wood or metal on site at a worksite such as, for example, on the ground adjacent to where they are to be tilted up to form a wall. The on-site building of such forms is a tedious and time consuming process and further requires a high level of skill on behalf of workers to assure that the panels are all the correct size and configuration. In addition, where wooden forms are used, the process of disassembling the framing members and discarding them after the concrete cures can be time consuming and wasteful. In most cases, reinforcing stakes, spacers, or blocks must be used to reinforce the sides of the concrete forms so that they do not bow outwardly or otherwise deform under the substantial pressures created by the wet concrete poured into the forms. Installing these reinforcing members is yet another time consuming step in the process.

Another problem with prior art techniques relates to the installation within the concrete forms of the rebar, wire mesh, or other reinforcing members that are to be embedded within the finished wall sections. More particularly, the construction of a matrix of reinforcing members is a time consuming and tedious process. This is particularly true in systems where the walls of the form are made from inwardly open channel shaped steel or formed sheet metal. The reason is that the reinforcing members must be installed in the mid-portion of the form between the inwardly projecting lips of the walls. In order the accomplish this, the framing members must be cut to be longer than the distance between the facing edges of opposed lips and jockeyed into place in the middle of the form before being secured in place within the form.

There exists a need for an improved tilt-up concrete wall form and a method of fabricating concrete wall sections using the form that addresses and solves the above mentioned and other problems of the prior art. The form should be lightweight, strong, and portable so that they can be manufactured to exacting tolerances at a remote location and delivered to a job site on a truck for immediate use. Further, the form should be usable without the need for any on-site form construction and without the need to reinforce the walls of the form against bowing under pressure when concrete is poured into the form. No deconstruction of the form should be required after the concrete cures and no waste that requires disposal should be generated during use of the form. At a remote form fabrication facility, fabrication should be quick and efficient and the installation of a matrix of reinforcing rebar in the mid-portion of the form should be accurate, quick, and efficient. An improved method of fabricating tilt-up concrete wall sections using such an enhanced form also should be included. It is to the provision of such a form and method of construction that the present invention is primarily directed.

SUMMARY OF THE INVENTION

Briefly described, the present invention, in a preferred embodiment thereof, comprises an improved form for fabricating tilt-up concrete wall sections and an improved method of fabricating tilt-up concrete wall sections using the form. The form has generally C-shaped or channel-shaped roll formed sheet metal frame members that are welded together at their ends to define the shape of the form, which may be rectangular for many applications but that also may take on other shapes according to application specific requirements. A matrix or mat of crisscrossed rebar is disposed in the form to provide reinforcement when concrete is poured into the form during fabrication of a concrete wall section. Each rebar of the matrix extends between opposed frame members of the form and is cut to be short enough to slip into the mid-portion of the form past the inwardly extending flanges of the C-shaped frame members. A unique bracket is slidably disposed on the ends of at least some of the rebars of the rebar mat and each bracket is spot welded to the corresponding frame member and to its rebar. This configuration establishes structural integrity of the assembly. Brackets may be disposed on the ends of each rebar or just on the ends of selected ones of the rebars as necessary to hold the reinforcing mat in place and to establish the desired structural integrity. The form is fabricated at a remote manufacturing facility as follows. First, the roll formed sheet metal frame members are cut to size and welded together at their ends to define a frame of the appropriate size and shape. The generally channel-shaped frame members are oriented with their open or channeled sides facing inwardly toward the middle of the form. In other words, the flanges on the edges of the frame members face inwardly toward each other and thus may be referred to as inwardly extending flanges. Down turned lips preferably are formed along the edges of the flanges to add strength and rigidity.

The crisscrossed rebar mat is then constructed by arranging individual rebars and welding them together at their intersections. A bracket is slid onto the ends of each rebar until the rebar ends protrude from the base of the bracket. With the mat constructed and brackets installed, the entire rebar mat can be positioned in the form. Since the rebars are cut short as mentioned above, the entire rebar mat slips easily past the inwardly extending flanges of the frame members and into the middle of the form. With the rebar mat properly positioned within the form, the brackets on the ends of the rebars are slid toward the frame members until the base of each bracket rests against the outside panel of the frame member between its inwardly projecting flanges. The base portions of the brackets are configured to extend between the flanges of the frame members, thereby automatically centering the rebar mat in the middle of the form. The bases of the brackets are then spot welded to the frame members and the end of each rebar is spot welded to its respective bracket to complete the form. It will thus be seen that the rebar mat is automatically centered and held in place by the brackets. Further, since the rebar mat is welded together and to the brackets, and the brackets are welded to the frame members, the completed form is strong and rigid and maintained in its proper shape by the installed rebar mat.

Since the forms of the present invention are lightweight and rigid, they may be handled, shipped to a jobsite where they are to be used to fabricate concrete wall sections, and unloaded at the job site without fear of the forms becoming warped or deformed. Once at the jobsite, the forms are laid flat on a casting surface, such as a concrete slab, preferably near the location where concrete wall sections are to be erected. The forms are then filled with concrete from a concrete truck, a pump truck, or other source. Again, since the brackets are welded to the frame members and the rebars of the mat welded to the brackets, the rebar mat ties the framing members together and prevents them from bowing or bulging outwardly under the pressure of the wet concrete. Accordingly, no further reinforcing blocks or other reinforcement is required prior to pouring the concrete into the forms as is common in prior art systems.

When the concrete is-cured, the resulting concrete wall sections may be tilted up using a derrick or crane and sling arrangement until they are in their proper positions, whereupon they may be attached together and/or to structural support members of the building to form walls. All of the elements of the form remain with the finished concrete wall sections and become a part of the finished wall. Accordingly, no disassembly of the form is required after the concrete cures and no waste that must be discarded is produced.

Thus, a unique and improved tilt-up concrete wall section form is now provided that is quickly, accurately, and efficiently fabricated at a remote manufacturing facility. The form is rigid and self reinforcing and may be handled and shipped to a job site, where it is simply laid on a casting surface and filled with wet concrete without the need for on-site construction or ancillary reinforcing members to prevent bowing of the form. When the concrete cures to form a wall section, the entire structure, form and all, is tilted up and attached to form a concrete wall without any disassembly or waste. The method of fabricating tilt-up concrete walls using forms of the present invention is efficient and substantially quicker than with prior art tilt-up wall systems. These and other features, objects, and advantages of the form and fabrication method of the invention will become more apparent upon review of the detailed description set forth below when taken in conjunction with the accompanying drawing figures, which are briefly described as follows.

DETAILED DESCRIPTION OF THE PREFERRED EMBODIMENTS

Figure 1:
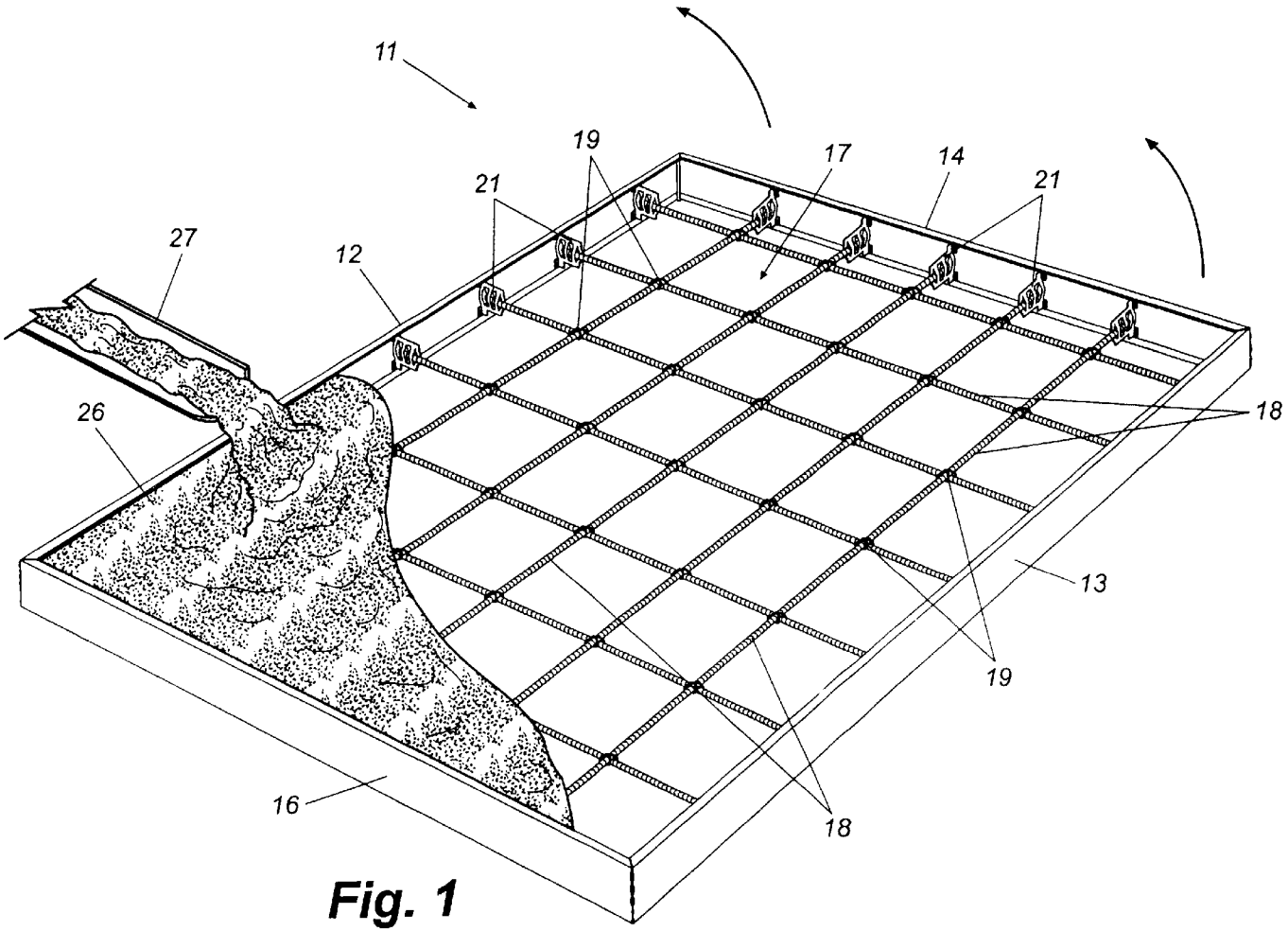
FIG. 1 is a perspective view of a tilt-up concrete wall form that embodies principles of the present invention in a preferred embodiment.
Figure 2:
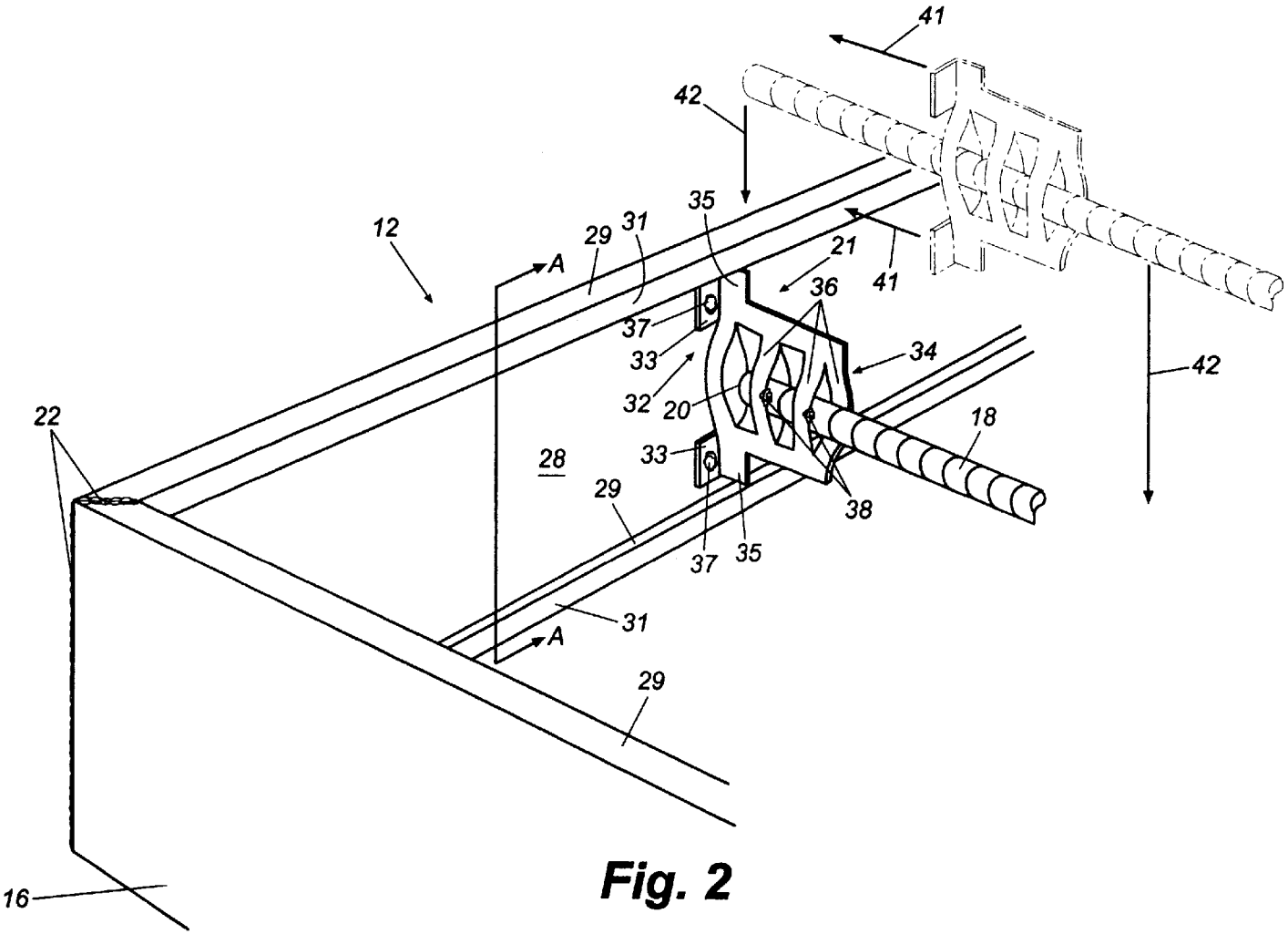
FIG. 2 is a close-up perspective view of a portion of the form of FIG. 1 showing details of the unique brackets for securing the rebar mat in place and illustrating installation of the rebar mat.

Referring now in more detail to the drawings, in which like reference numerals refer to like parts throughout the several views, FIG. 1 illustrates a preferred embodiment of the tilt-up concrete wall section form of the invention. The form 11 includes a pair of spaced apart side frame members 12 and 13 joined at their ends by a pair of end frame members 14 and 16 respectively. The frame members 12, 13, 14, and 16 preferably are formed from roll-formed sheet metal and, as discussed in more detail below, are generally C-shaped or channel shaped having inwardly extending flanges 29 and down turned lips 31 (best shown in FIG. 2). This configuration provides for rigid and strong frame members that nevertheless are lightweight. The frame members that define the frame of the form preferably are welded together at the frame corners by means of weld joints 22 (FIG. 2). Alternatively, some of the corners might be formed by appropriately bending a longer piece of frame stock if desired.

A rebar mat 17 is positioned in the form spanning the frame members and, in the preferred embodiment, is formed from individual rebars 18 crisscrossed with respect to each other and spot welded or otherwise attached together at their intersections 18. This forms a rebar mat that is rigid, strong, and not subject to being racked or deformed under stress. As discussed in more detail below, each rebar is cut short enough so that the rebar mat can be slipped into the mid-portion of the form past the inwardly extending flanges of the frame members. Thus, the rebar mat can be fabricated separately from the frame, whereupon it is simply placed in position within the frame.

A special sliding bracket 21 is mounted on each end of the individual rebars. The brackets 21 are slid onto the ends of the individual rebars before the rebar mat is positioned within the frame. When the mat is in position within the frame, the brackets are slid outwardly until they engage the outside panels of the frame members. As discussed in more detail below, the brackets are configured so that when they are slid out and engage the frame members, they automatically center their respective rebars within the form between the inwardly extending flanges of the frame members. Once in place, the base portions 32 (FIG. 2) of the brackets are spot welded to the frame members and the brackets are spot welded to the end portions of their respective rebars. This creates a completed form that is lightweight compared to prior art forms but that nevertheless is rigid and strong so that a plurality of such forms can be shipped from a manufacturing facility to a job site on a flat bed trailer with little danger of the forms becoming racked, deformed, or otherwise damaged during shipment.

In use, forms according to the present invention are fabricated in a manufacturing facility as described and shipped to a jobsite where tilt-up concrete walls are to be made and erected. There, the forms are located and laid flat on a casting surface, such as a concrete slab, preferably near where the concrete wall sections ultimately will be erected. The pre-fabricated forms are then filled with wet cement 26 from a source such as a pump truck or from the chute 27 of a concrete truck. As the concrete fills the forms, it exerts a great deal of outward pressure on the frame members of the form, as is the case regardless of the type of form used. However, since the frame members of the form of this invention are securely tied together by the spot welding of the brackets 21 to the frame members and to their respective rebars, the frame of the form easily withstands the pressure of the concrete without bowing or otherwise deforming. Therefore, no ancillary reinforcing blocks or stakes, common in the prior art, are required. In addition, the rigidity of the form prevents it from racking as the heavy concrete spreads throughout the form. As the concrete is poured into the form, it flows around and encases not only the rebar mat, but also the brackets at the ends of the individual rebars. This forms a solid monolithic structure as the concrete cures and the form becomes an integral part of the finished concrete wall. Once the concrete is cured, the resulting wall sections, form and all, are tilted up into place by a crane and secured to each other and to the building frame in the usual way to form concrete walls of the building.

FIG. 2 is an enlargement of a portion of the form of this invention showing details of its structure, and particularly details and interrelations of the frame, rebar, and bracket of the form. The side frame member 12 is shown attached by a weld joint 22 to an end frame member 16 forming a corner of the form. As mentioned above, the frame members are generally C-shaped or channel shaped, with the open channel of each frame member facing inwardly toward the center of the form. More specifically, the frame members, which preferably are made of roll-formed or otherwise bent sheet metal, have an outside panel portion 28 that is bent or roll formed along its edges to form inwardly extending flanges 29 and down turned lips 31. This configuration provides strength and rigidity to the frame members. However, it also forms a bit of a channel around the inside of the frame with the distance between inwardly extend flanges of opposed frame members being less than the distance between their respective outside panels.

One rebar 18 of the rebar mat 17 is visible in FIG. 2 along with the bracket 32 by which it is attached to the frame member 12. The rebar and bracket also are illustrated in phantom lines with arrows to demonstrate more clearly the positioning of the rebar mat into the form and subsequent attachment thereto by means of the bracket. As mentioned above, the individual rebars of the mat are cut short enough so that the mat can be moved into to position within the form past the inwardly extending flanges 29 and down turned lips 31 of the frame members. This means that when the rebar mat is in place, there is a space between the ends of the rebars and the outside panels 28 of the frame members and thus the rebar mat cannot be attached directly to the frame. Brackets 21 were invented to address this problem and to provide additional advantages. Each bracket 21 has a base portion 32 formed with outturned welding flanges 33. A flange 34 extends from the base portion 32 and is dye or otherwise cut to form a plurality of ribs 36. Alternate ones of ribs 36 are spread apart relative to each other to form an open pocket that can be slipped over the end portion of a length of rebar as shown. When the rebar mat is installed in the form as shown in solid lines in FIG. 2, spot welds 37 fasten each of the brackets 21 to the outside panel of their respective frame members while spot welds 28 secure the end of the rebar to the ribs of the bracket 21, for purposes and advantages discussed above.

The preferred installation of the rebar mat into the form is illustrated by phantom lines and arrows in FIG. 2. More specifically, prior to moving the rebar mat into the form, brackets are slipped onto the ends of the individual rebars of the mat until the end portions of the rebars protrude from the base portions of the brackets. The rebar mat may then be moved into the form as indicated by arrows 42 until it is located approximately in the mid-portion of the form. This is possible, as mentioned earlier, because the rebars are short enough to slip past the inwardly extending flanges of the frame members. With the rebar mat in position, the brackets are slid outwardly, as indicated by arrows 41, until their base portions engage the outside panel portions of the frame members, whereupon they are spot welded to the frame members and to the end portions of their respective rebars. The manufacture of the form of this invention is therefore greatly simplified as compared to the prior art but nevertheless results in a form of superior strength, light weight, portability, and rigidity.

Figure 3:
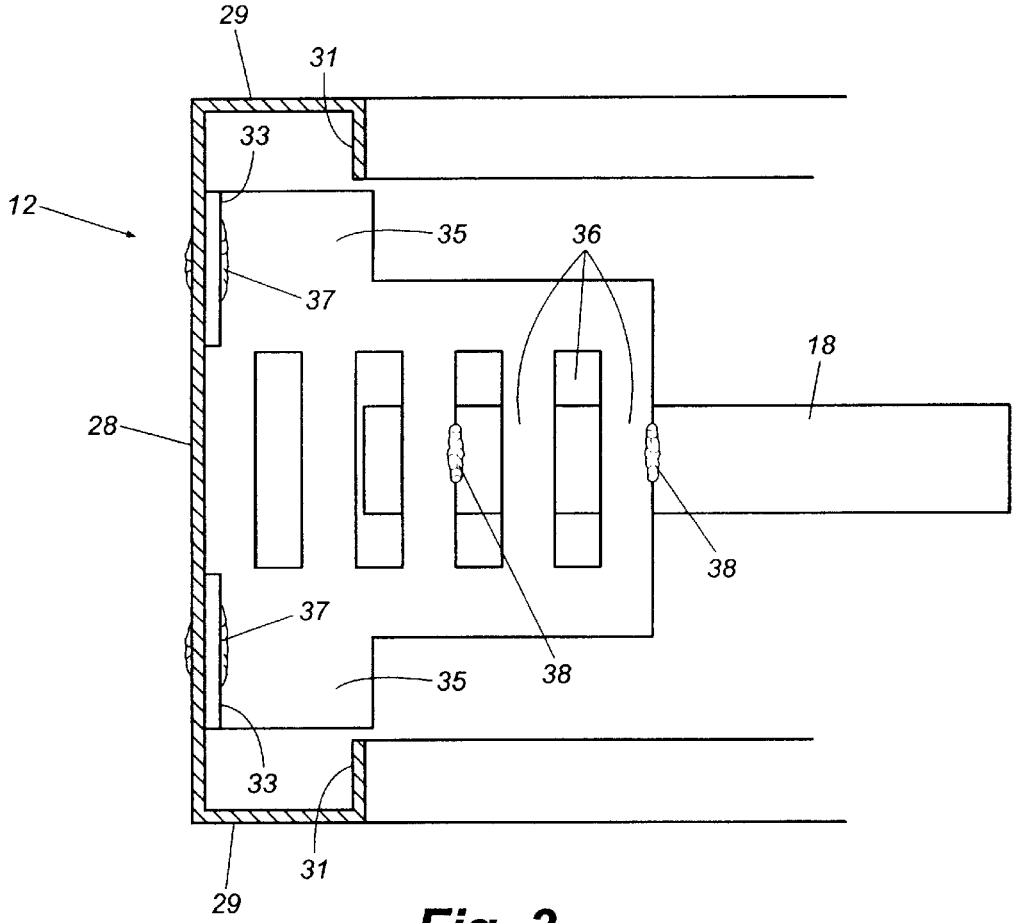
FIG. 3 is a cross-sectional view taken along A—A of FIG. 2 illustrating more clearly the relationship between the C-shaped frame members, the rebar mat, and the brackets of the invention.

FIG. 3 is a cross-sectional view taken along A—A of FIG. 2 illustrating more clearly the relationship between the rebar, bracket, and frame member. Here, the shortened length of the rebar 18 for slipping easily into the form past the inwardly extending flanges 29 is more clearly shown. The bracket 21 is shown with its base portion engaging and being spot welded at 37 to the outside panel portion 28 of the frame member and also spot welded to the end portion of the rebar at 38. Each of the brackets 21 is further formed with a pair of alignment wings 35 that project outwardly a distance such that the alignment wings reside between the opposed inner edges of the down turned lips 31 of the frame member. In this way, the alignment wings function to align the rebar mat in the mid-portion of the form as the brackets are slid outwardly to engage the frame members and to maintain its alignment during transport and while the form is filled with wet concrete.

The invention has been described in terms of preferred embodiments and methodologies that represent the best mode known to the inventors of carrying out the invention. It will be apparent to those of skill in the art, however, that many variations of the illustrated embodiments may be implemented, all within the scope of the invention. For example, the specific shape and construction of the brackets 21 shown in the drawings is one preferred embodiment because of its light weight and economy of fabrication. Many other bracket configurations may, however, be substituted depending upon the shape of the frame, the application, or other factors and any and all specific bracket shapes should be considered equivalent. The specific channel-shape of the frame members also may be different from that illustrated and discussed above. For instance, frame members with inwardly facing C-shaped channels are illustrated and discussed. However, the frame members can take on any of a variety of shapes and configurations depending upon structural and architectural requirements. For example, the frame members can have outwardly extending flanges rather than inwardly extending flanges, obliquely projecting flanges, or may not have any flanges at all. Thus, the particular configuration of the frame members illustrated in the drawings and discussed herein is not intended to and should not be interpreted as limiting the scope of the invention. The forms themselves, although illustrated only as rectangular forms for clarity of description, may take on a wide variety of shapes depending upon the desired final shape of walls to be made with them. For instance, a wall section that will be on the end of a building may be poured in a form having a triangular upper portion to match the pitch of the building roof. These and other additions, deletions, and modifications to the particular preferred embodiment illustrated and discussed herein might well be made by those of skill in the art without departing from the spirit and scope of the invention as set forth in the claims.

What is claimed is:

1. A form for fabricating tilt-up concrete wall sections, said form comprising:

a frame formed by a plurality of spaced apart frame members attached together at their ends, wherein said frame members are made of metal and wherein each of said frame members is generally C-shaped having flanges that extend inwardly toward the interior of said frame;

a reinforcing mat formed by crisscrossed reinforcing members, said reinforcing mat being disposed within said frame with ends of its reinforcing members located adjacent respective ones of said frame members;

a plurality of brackets slidably disposed on the ends of at least some of said reinforcing members, each of said brackets securing the end of its respective reinforcing member and being fixed to said frame member to hold said reinforcing mat in place within said frame member and to provide structural integrity to said form.

2. A form for fabricating tilt-up concrete wall sections as claimed in claim 1 and wherein said reinforcing mat is sized to be moved into said frame past said inwardly extending flanges.

3. A form for fabricating tilt-up concrete wall sections as claimed in claim 2 and wherein said C-shaped frame members form an inwardly facing channel defined by an outside panel portion of said frame members and said inwardly extending flanges, and wherein said brackets are slidable on said reinforcing members to be slid against and attached to said outside panel portions of said frame members after said reinforcing mat is moved into said frame.

4. A form for fabricating tilt-up concrete wall sections as claimed in claim 3 and wherein said brackets are fixed to the end portions of said reinforcing members after having been slid against and attached to said outside panel portions of said frame members.

5. A form for fabricating tilt-up concrete wall sections as claimed in claim 4 and wherein said reinforcing members are rebar arranged in a crisscrossed pattern to form said reinforcing mat, said brackets being disposed on the ends of at least some of said rebars.

6. A form for fabricating tilt-up concrete wall sections as claimed in claim 1 and wherein said frame members further are formed with down turned lips.

7. A form for fabricating tilt-up concrete wall sections as claimed in claim 6 and wherein said brackets are configured with alignment tabs that fit between said down turned lips to align said reinforcing mat within said frame.

8. A form for fabricating tilt-up concrete wall sections as claimed in claim 7 and wherein said brackets are stamped from sheet metal and have a ribbed pocket for receiving and holding the end portions of said reinforcing members.

9. A method of fabricating a concrete form comprising the steps of:

(a) forming a frame from a plurality of frame members attached together at their ends, the frame members forming sides of the frame;

(b) forming a reinforcing mat from a plurality of reinforcing members having ends, said reinforcing mat being sized and configured to be moved into said frame with the ends of said reinforcing members located adjacent respective ones of said frame members;

(c) slidably disposing brackets on the ends of at least some of the reinforcing members of the mat;

(d) positioning the reinforcing mat in the frame;

(e) sliding the brackets outwardly on their reinforcing members until they engage respective frame members;

(f) securing the brackets to the frame members to mount the reinforcing mat within the frame; and (g) securing the brackets to the ends of their respective reinforcing members; wherein the step of securing the brackets to the frame members and the step of securing the brackets to the ends of their respective reinforcing members includes welding.

10. A method of forming a tilt-up concrete wall comprising the steps of:

constructing a frame from a plurality of metal frame members, said frame members forming the sides of the frame;

constructing a mat from a plurality of rebars having ends and arranged in a crisscrossed pattern and wherein the rebars are attached together at their intersections, the mat being sized and configured to be positioned within said frame with the ends of the rebars located adjacent respective ones of said frame members;

slidably disposing a plurality of brackets on the ends of at least some of said rebars:

positioning the mat in the frame;

sliding the brackets outwardly on the ends of their respective rebars and into engagement with the frame members;

attaching the brackets to the frame members to fix and position the mat of rebars within the frame and to provide structural integrity to the frame and wherein the method of attaching the brackets comprises welding;

attaching the brackets to the ends of their respective rebars and wherein the method of attaching the brackets comprises welding;

locating the frame on a casting surface;

filling the frame with concrete; and when the concrete is cured, tilting the resulting concrete wall, including the frame, into place to form a wall.

* * * * *